United States Patent [19]

Jackson et al.

[11] Patent Number: 4,819,930

[45] Date of Patent: Apr. 11, 1989

[54] APPARATUS FOR STACKING COPY SHEETS

[75] Inventors: Richard W. Jackson, Barrington; Eugene P. Oddo, Mt. Prospect, both of Ill.

[73] Assignee: AM International, Inc., Chicago, Ill.

[21] Appl. No.: 602,777

[22] Filed: Apr. 23, 1984

[51] Int. Cl.[4] ..... B65H 31/00

[52] U.S. Cl. ..... 271/209; 271/213; 271/223; 271/186

[58] Field of Search ..... 271/186, 65, 66, 67, 271/69, 70, 207, 209, 213, 223, 224, 198, 314, 278

[56] References Cited

U.S. PATENT DOCUMENTS

| | | | |
|---|---|---|---|
| 848,777 | 4/1907 | Smith | 271/213 |
| 2,632,643 | 3/1953 | Egan et al. | 271/213 X |
| 3,889,942 | 6/1975 | Robnolte | 271/3 |

FOREIGN PATENT DOCUMENTS

| | | | |
|---|---|---|---|
| 925871 | 5/1963 | United Kingdom | 271/68 |

*Primary Examiner*—Joseph J. Rolla

*Attorney, Agent, or Firm*—Nicholas A. Camasto; John R. Hoffman

[57] ABSTRACT

An apparatus for stacking large copy sheets beneath a tabletop model whiteprint, blueprint or similar copying machine. A support structure spaces the copying machine above a subjacent support surface as a tabletop, floor or the like. A receptacle structure is disposed below and forwardly of the exit port of the machine for arresting the leading edges of the copy sheets as the sheets are discharged seriatim from the copying machine and for causing the sheets to bow rearwardly onto a stack in the stacking space beneath the machine. The apparatus can be provided in kit form for application to existing copying machines.

22 Claims, 3 Drawing Sheets

APPARATUS FOR STACKING COPY SHEETS

BACKGROUND OF THE INVENTION

This invention relates generally to copying machines and particularly to apparatus for stacking large copy sheets discharged from a whiteprint, blueprint or similar copying machine.

It is widely known to provide stacking devices or trays at the exit ends of copying machines for collecting copy sheets and neatly stacking the sheets for removal from the machine. Most such stacking devices normally have been designed for relatively small copy sheets and often rely upon the inherent stiffness of the sheets to facilitate the positioning and stacking of the sheets. For instance, the inherent stiffness of relatively small copy sheets often is utilized to advantage in transporting the sheets and deflecting the sheets into stacking position.

Devices of the character described above are not applicable for use with whiteprint, blueprint or similar copying machines which handle relatively large copy sheets. One such machine uses the diazo process where a translucent original is placed upon a relatively large sheet of sensitized diazo coated paper and the two sheets are fed together through the machine. The sheets are carried around a transparent cylinder which contains an ultraviolet lamp. Wherever the light passes through the original to the copy the sensitized coating on the copy is decomposed leaving the copy paper white. Wherever the image on the original shields the copy paper from the light, the sensistized coating will remain as a latent image. After being separated from the original, the exposed copy paper passes into a developer section where a thin film of activator is applied. The activator combines with the coating in the latent image area and forms a visible image on the copy material. The copy then emerges from the machine as a flat, dry print ready for immediate use. This is but one type of copying machine to which the present invention is applicable, in that the size of the copy sheets may be as large as 24×36 inches.

It is readily apparent that because of the large size sheets used in whiteprint and blueprint copying machines, most known stacking devices cannot be employed because of the lack of inherent stiffness in the large size copy sheets. In essence, the large sheets are somewhat "limp" as they emerge from the copying machine.

Machines of the character described also are manufactured in relatively large "console" as well as smaller "tabletop" models. In the console models, the sheets normally are fed into the front of the machine and are discharged from the rear of the machine. In tabletop models, the sheets are fed into the front of the machine and also are discharged from the front of the machine. Copending patent application Ser. No. 602,778, filed Apr. 23, 1984, and assigned to the assignee of the instant application, discloses an apparatus for a console-type machine which not only stacks the large copy sheets but inverts the orientation of the sheets discharged from the rear of the machine.

As with the need satisfied by the apparatus of that application, there is a definite need for a simple apparatus for stacking large copy sheets discharged from the front of a smaller tabletop machine. Heretofore, an operator loaded the machine with individual sets of sheets, i.e. the original and the coated copy paper, and manually removed the sheets as they were discharged from the machine. The present invention is directed to eliminating this burdensome manual unloading of such whiteprint, blueprint or similar machines.

SUMMARY OF THE INVENTION

An object, therefore, of the invention is to provide a new and improved stacking device for copy sheets emerging from a copying machine.

Another object is to provide a stacking apparatus for collecting large copy sheets discharged from such copying machines as whiteprint, blueprint or similar machines.

In the exemplary embodiment of the invention, the apparatus includes means for supporting and spacing a copying machine above a subjacent support surface. In one form of the invention, the supporting and spacing means are readily applicable for supporting the machine above a tabletop or the like. In another form of the invention, the supporting and spacing means are designed for supporting the copying machine at a working height above a floor or the like. In both forms the supporting means provides a stacking space immediately beneath the copying machine.

Receptacle means are disposed below and fowardly of the exit port of the machine for arresting the leading edges of the copy sheets as the sheets are discharged from the machine and for causing the sheets to bow rearwardly onto a stack in the stacking space beneath the machine. The receptacle means include forward wall means projecting upwardly at a position below and forwardly of the exit port of the machine for arresting the leading edges of the copy sheets. Generally horizontal wall means project rearwardly of the forward wall means toward the stacking space beneath the machine and onto which the copy sheets bow onto a stack.

With the form of the invention adapted for use with a tabletop or the like, the table itself provides additional support behind the machine for relatively large copy sheets. With the form of the invention which includes a stand for supporting the copying machine at working height above a floor, the receptacle means include means forming an extension of the generally horizontal wall means projecting rearwardly of the machine for supporting the relatively large size copy sheets in a stack.

The invention contemplates providing the supporting and spacing means and the receptacle means in the form of a kit which is readily mountable to the underside of an existing copying machine to create the stacking space beneath the machine.

Other objects, features and advantages of the invention will be apparent from the following detailed description taken in connection with the accompanying drawings.

DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
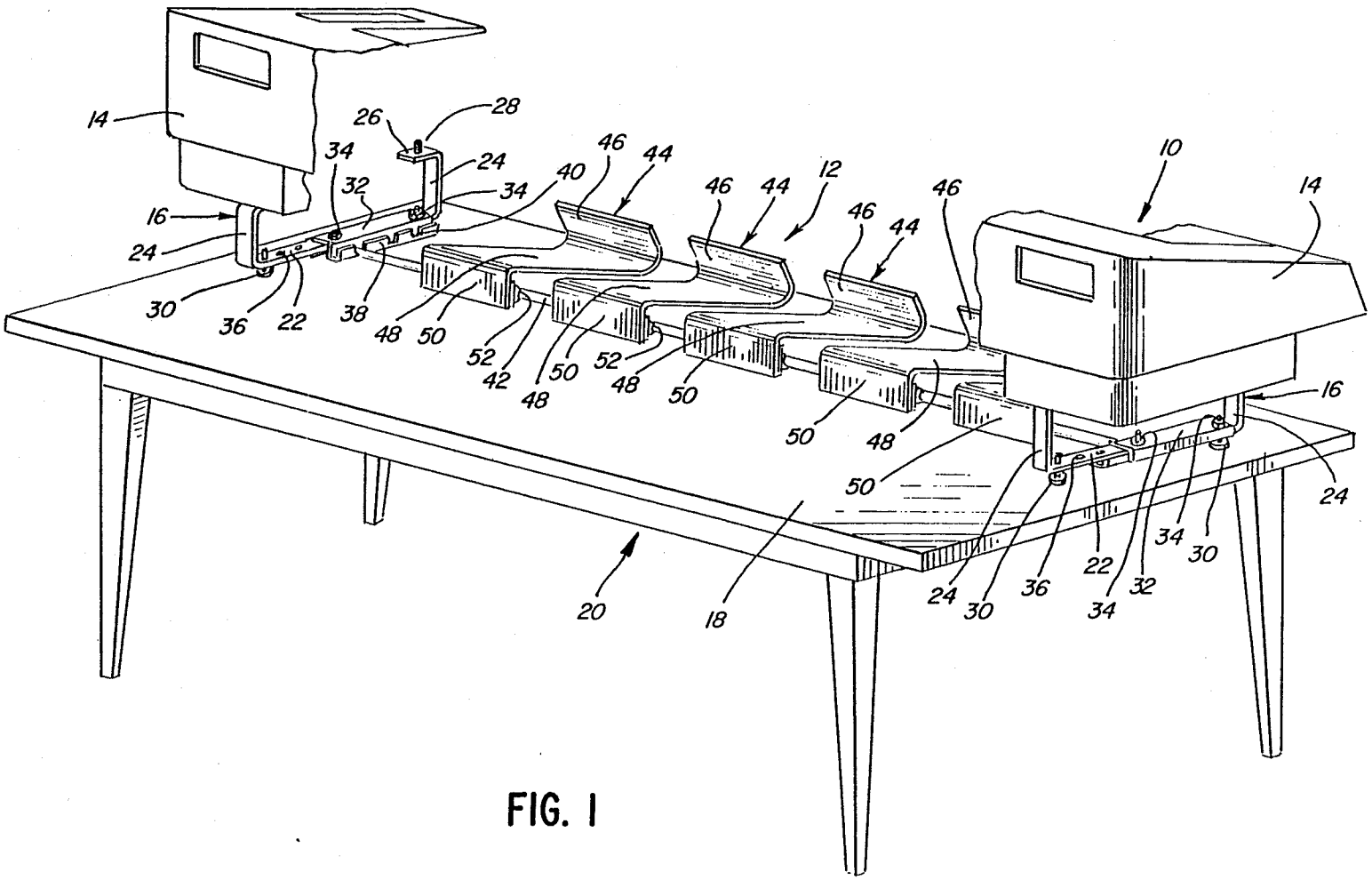
FIG. 1 is a fragmented perspective view of at tabletop model copying machine supported above the top of a table by the stacking apparatus of the invention.

Referring to the drawings in greater detail, and first to FIG. 1, the rear or back side of a tabletop copying machine, generally designated 10, is illustrated with a stacking apparatus, generally designated 12, in accordance with the invention and mounted beneath the machine. In contrast with larger console model copying machines in which the sheets are fed into the front of the machine and emerge from the rear of the machine, most tabletop model copying machines of the character described have the entry and exit port common and disposed at the front of the machine.

Copying machine 10 includes a body 14 which houses the interior components of the machine. For instance, the machine may use the diazo process and all of the components related therewith, including feed rollers, ultraviolet lamp cylinders, fans, developer sections and the like, are disposed inside the housing.

Machines as described herein are capable of and most often handle relatively large size copy sheets. It would not be unusual for the machine to handle sheets of a size on the order of 18×24 inches or 24×36 inches. Because of the sheet size, the sheets exit from the machine somewhat 'limp' and difficult to handle. Heretofore, the sheets normally exit from the front of a tabletop machine and are individually removed therefrom by an operator. The invention is directed to providing a novel stacking device of apparatus which receives the sheets emerging seriatim from the copying machine and stacking the sheets in a manner efficiently utilizing space directly beneath the machine, with the copy sheets forming a stack below and behind the machine away from the normal area occupied by an operator working in front of the machine.

More particularly, stacking apparatus 12 includes means, generally designated 16, for supporting and spacing copying machine 10 above a subjacent support surface such as the top 18 of a table or the like, generally designated 20. The supporting and spacing means 16 is in the form of a pair of generally U-shaped brackets positioned at opposite ends of copying machine 10. Each U-shaped bracket includes a generally horizontal bight portion 22, a pair of upstanding leg portions 24 at opposite ends of bight portion 22, and inwardly turned flange portions 26 at the top of upstanding leg portions 24. Bolts 28 extend through flanges portions 26 to removably mount the U-shaped brackets to the underside of copying machine 10. Adjustable feet 30 are threaded through opposite ends of bight portion 22 to adjust the height of the copying machine above top 18 of table 20.

For purposes described hereinafter, slides 32 are clamped to bight portions 22 of the U-shaped brackets by means of bolts 34 positionable through a series of holes 36 through the bight portions. Consequently, the slides can be adjusted longitudinally of the brackets. A flange 38 is disposed inwardly of each slide 32 and has a plurality of notches 40 along an upper edge thereof for receiving a transverse rod 42 extending lengthwise beneath copying machine 10. Rod 42 can be positioned in any of the notches along flange 38 for positional adjustment forwardly and rearwardly of the copying machine.

Stacking apparatus 10 also includes receptacle means in the form of a plurality of trough-like sections 44 spaced along the length of rod 42. Generally, the trough sections define receptacle means disposed below and outwardly of the exit port of copying machine 10 for arresting the leading edges of the copy sheets as the sheets are discharged seriatim from the machine and for causing the sheets to bow onto a stack in the space beneath the copying machine.

More particularly, each trough section 44 includes a forward wall 46 projecting upwardly and slightly inclined inwardly at a disposition below and forwardly of the exit port of the machine. A generally horizontal wall 48 projects rearwardly and is inclined upwardly of forward wall 46 toward the stacking space beneath the copying machine. A lip 50 projects downwardly from the rear edge of horizontal wall 48 and has a pair of resilient C-clamp structures 52 on the inside of lip 50 for clamping each trough section 44 onto transverse rod 42.

Figure 2:
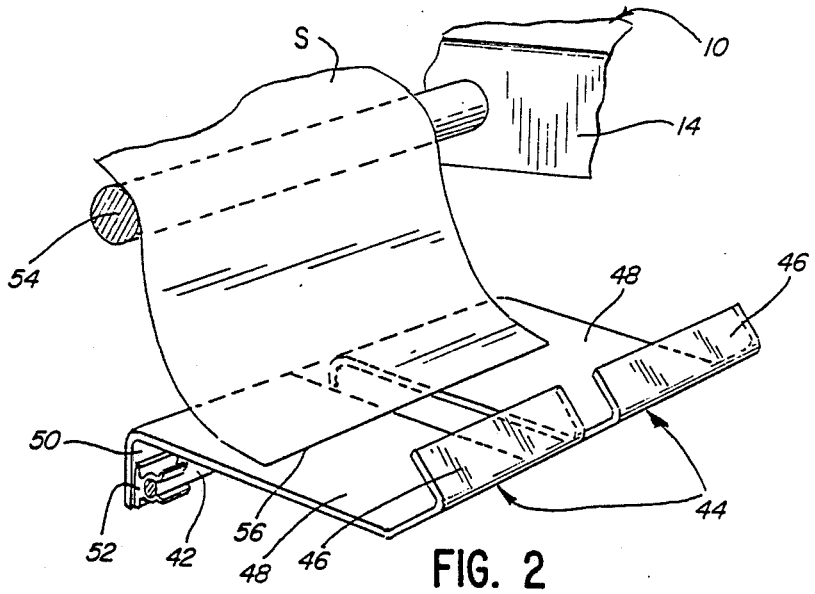
FIG. 2 is a fragmented perspective view illustrating a copy sheet being discharged from the copying machine into the receptacle means of the invention.

Referring to FIG. 2, a copy sheet "s" is illustrated emerging off of a discharge roller 54 from the machine and onto the horizontal walls 48 of trough sections 44. The horizontal walls guide the leading edge 56 of the sheet into abutment with the forward walls 46 of the trough sections whereupon the sheet is arrested. By slightly inclining forward walls 46 of the trough sections rearwardly, captivation of the leading edge of the sheet against the forward walls is facilitated.

Figure 3:
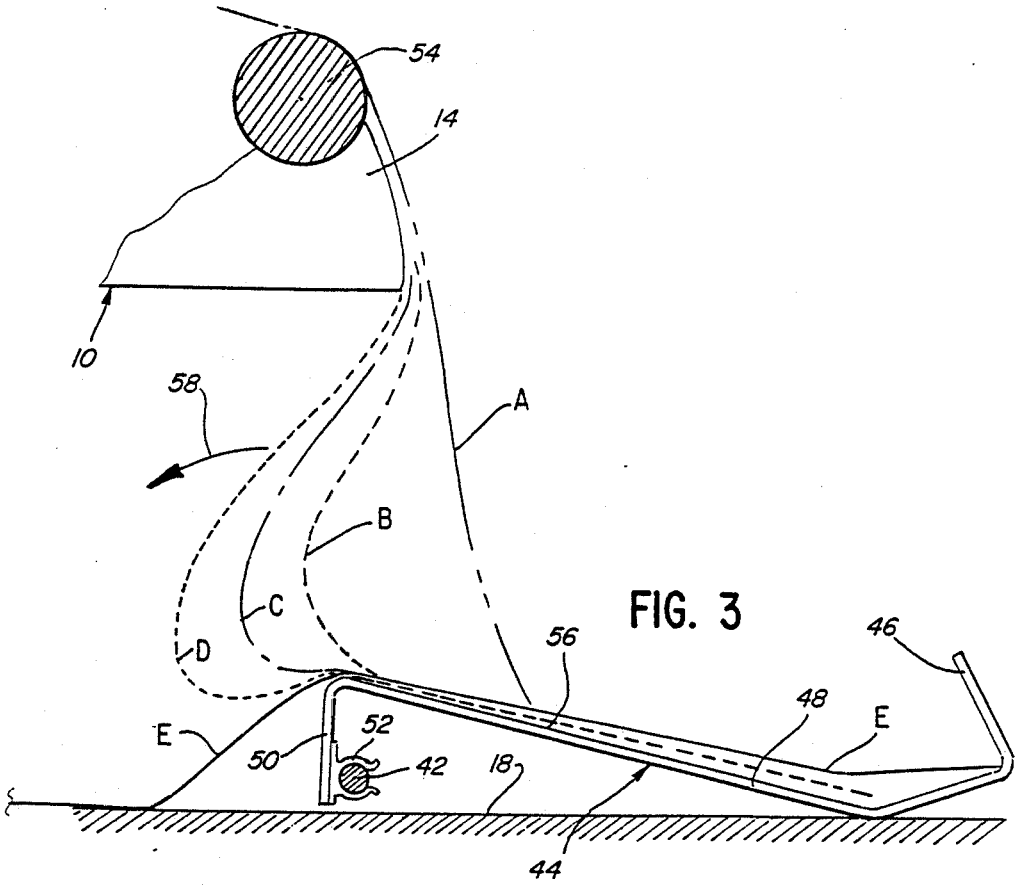
FIG. 3 is an end view, on an enlarged scale, illustrating various positions of a copy sheet as it exits from the machine and folds onto the stacking apparatus of the invention.

Referring to FIG. 3, it can be seen that trough sections 44 which, in part, define the receptacle means of the invention, are disposed below and forwardly of discharge roller 54 at the exit port in front of copying machine 10. The progression of a copy sheet as it emerges from the machine off of discharge roller 54 is illustrated by various line configurations designated "A" through "E". Specifically, "A" shows a copy sheet emerging from the machine with the leading edge 56 of the sheet engaging, by gravity, horizontal walls 48 of trough sections 44. "b" shows the sheet progressing forwardly along horizontal walls 48 toward forward walls 46 of the trough sections, as the sheet begins to bow rearwardly due to the frictional resistance of movement of the sheet along horizontal walls 48. "C" shows the sheet arrested and captivated by forward walls 44, with the sheet bowing further in a rearward direction into the stacking space beneath the copying machine. "D" further shows the sheet bowing rearwardly until the sheet will fall by gravity in the direction of arrow 58 until the sheet assumes a stacked position as indicated at "E". As successive sheets emerge from the machine, each sheet will follow the same pattern as described above as it is arrested and caused to bow and fold onto the preceding sheet in a neat stack extending beneath the copying machine.

The forward or rearward disposition of trough sections 44 can be adjusted both by positioning rod 42 in selected notches 44 in flange 38 as well as by slidably adjusting the position of slides 32, as described above in relation to FIG. 1. It has been found that this adjustment is helpful in facilitating the bowing and folding of different sizes of relatively large copy sheets.

Furthermore, it can be seen best in FIG. 3 that walls 48 of trough sections 44 are not literally horizontal. The term "horizontal" to describe wall means 48 is used at times in the specification and claims herein to facilitate the description and is not meant to be interpreted as a strict horizontal disposition of those portions of the trough sections.

Figure 4:
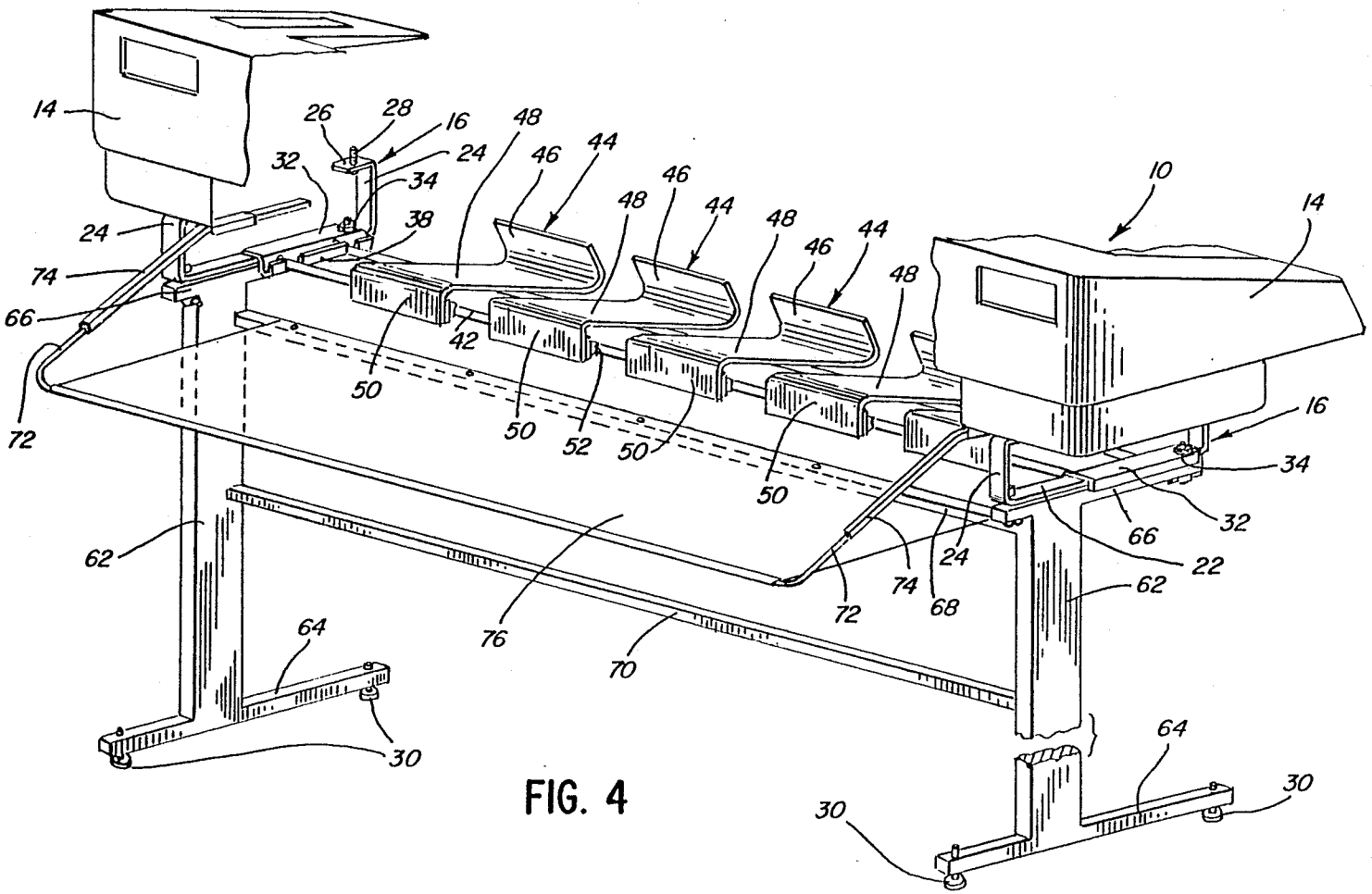
FIG. 4 is a fragmented perspective view similar to that of FIG. 1 and illustrating the form of the invention which includes a stand for supporting the copying machine at a working height above a floor.

Referring to FIG. 4, stacking apparatus 12 of the invention is illustrated for use on a separate stand, generally designated 60, instead of using the apparatus in conjunction with an existing tabletop. Like numerals have been applied to FIG. 4 to designate like components described in relation to FIG. 1-3.

More particularly, stand 60 includes a pair of generally I-shaped end supports which include vertical leg portions 62, lower horizontal leg portions 64 and upper horizontal leg portions 66. Upper and lower cross braces 68 and 70, respectively, are secured to and span the vertical leg portions 62.

Means are provided for forming an extension behind trough sections 44, projecting rearwardly of copying machine 10, for supporting relatively large size copy sheets in a stack. Specifically, a U-shaped rod-like frame 72 is telescoped into a pair of brace members 74 secured to the underside and at opposite ends of copying machine 10. A thin sheet 76 of plastic material is secured along its rear edge to the bight portion of rod-like frame 72. The plastic sheet is stretched and secured along its front edge to upper cross brace 68. Therefore, as a copy sheet progressively bows rearwardly from trough sections 44 as described in relation to FIG. 3, the sheet will fall by gravity onto plastic sheet 76, similarly as if the invention were used in conjunction with a tabletop.

It is contemplated that both forms of the invention shown in FIGS. 1 and 4 can be manufactured and supplied in kit form for application and use with existing tabletop model copying machines 10. All of the components such as U-shaped brackets 16, slides 32, trough sections 44 and transverse rod 42, along with the fastening and mounting components associated therewith, can be easily packaged and provided in a single kit for application to existing copying machines. The same is true for stand 60, rod-like frame 74, plastic sheet 76 and related components which can be additionally supplied and used as described in relation to FIG. 4.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An apparatus for stacking large copy sheets discharged from the exit port of a whiteprint, blueprint or similar copying machine, comprising:

means for supporting and spacing said copying machine above a subjacent support surface such as a tabletop or the like to define an open space immediately below and extending rearwardly beneath the copying machine; and receptacle means disposed below and outwardly of said exit port for arresting the leading edges of said copy sheets as the sheets are discharged from the machine in an exiting direction and for causing the sheets to bow opposite said exiting direction onto a stack substantially beneath the machine in the space between the copying machine and the subjacent support surface.

2. The apparatus of claim 1 wherein said receptacle means include forward wall means projecting upwardly at a disposition below and forwardly of said exit port for arresting the leading edges of the copy sheets.

3. The apparatus of claim 2 wherein said receptacle means include generally horizontal wall means projecting rearwardly of said forward wall means toward the space between the copying machine and the subjacent support surface and onto which the copy sheets bow onto a stack.

4. The apparatus of claim 3 wherein said forward wall means are inclined rearwardly to facilitate captivating the leading edges of the copy sheets as the sheets are discharged from said exit port.

5. The apparatus of claim 3 wherein said receptacle means are secured to said supporting and spacing means at the rear of said generally horizontal wall means.

6. The apparatus of claim 5 wherein said receptacle means include means forming an extension of said generally horizontal wall means projecting rearwardly of said supporting and spacing means.

7. The apparatus of claim 1, including means for adjusting said receptacle means forwardly and rearwardly relative to said exit port.

8. A kit for use with a copying machine as set forth in claim 1 wherein said kit includes said supporting and spacing means and said receptacle means, said kit including means for removably mounting said supporting and spacing means to said copying machine to so position said receptacle means at a position below and outwardly of said exit port.

9. The kit of claim 8 wherein said last named means mounts the supporting and spacing means to the underside of the copying machine.

10. An apparatus for stacking large copy sheets discharged from the exit port of a whiteprint, blueprint or similar copying machine, comprising:

means for supporting and spacing said copying machine above a subjacent support surface such as a tabletop or the like to define an open space immediately below and extending rearwardly beneath the copying machine; and receptacle means including forward wall means projecting upwardly and inclined rearwardly at a disposition below and forwardly of said exit port for arresting and captivating the leading edges of the copy sheets as the sheets are discharged from the copying machine in an exiting direction and causing the sheets to bow opposite said exiting direction rearwardly into the space between the copying machine and the subjacent support surface, generally horizontal wall means projecting rearwardly of said forward wall means toward the space between the copying machine and the subjacent support surface and onto which the copy sheets bow onto a stack substantially beneath the copying machine, the rear of said generally horizontal wall means being secured to said supporting and spacing means.

11. The apparatus of claim 10 wherein said receptacle means comprise a plurality of individual trough sections defining said wall means and spaced laterally along the exit end of the copying machine.

12. The apparatus of claim 11 wherein said supporting and spacing means include an elongated rod extending along and spaced beneath the copying machine, and including securing means for removably attaching said trough sections to said rod.

13. The apparatus of claim 10, including means for adjusting said receptacle means forwardly and rearwardly relative to said exit port.

14. A kit for use with a copying machine as set forth in claim 10 wherein said kit includes said supporting and spacing means and said receptacle means, said kit including means for removably mounting said supporting and spacing means to said copying machine to so position said receptacle means at a position below and forwardly of said exit port.

15. The kit of claim 14 wherein said last named means mounts the supporting and spacing means to the underside of the copying machine.

16. An apparatus for stacking large copy sheets beneath a tabletop-type whiteprint, blueprint or similar copying machine which has a feed port and exit port at the front of the machine, comprising:

stand means for supporting the copying machine at working height above a subjacent support surface such as a floor or the like and providing stacking space immediately below and extending rearwardly beneath the copying machine; and receptacle means disposed below and forwardly of an exit port of the copying machine for arresting the leading edges of the copy sheets as the sheets are discharged from the copying machine in an exiting direction and causing the sheets to bow opposite said exiting direction rearwardly onto a stack in said stacking space substantially beneath the copying machine.

17. The apparatus of claim 16 wherein said receptacle means include forward wall means projecting upwardly at a disposition below and forwardly of said exit port for arresting the leading edges of the copy sheets.

18. The apparatus of claim 17 wherein said receptacle means include generally horizontal wall means projecting rearwardly of said forward wall means toward said stacking space and onto which the copy sheets bow onto a stack.

19. The apparatus of claim 18 wherein said forward wall means are inclined rearwardly to facilitate captivating the leading edges of the copy sheets as the sheets are discharged from said exit port.

20. The apparatus of claim 19 wherein said receptacle means include means forming an extension of said generally horizontal wall means projecting rearwardly of the machine for supporting relatively large size copy sheets in said stack.

21. The apparatus of claim 20 wherein said extension means comprise a surrounding rod-like frame spanned by a thin sheet of plastic material.

22. The apparatus of claim 16, including means for adjusting said receptacle means forwardly and rearwardly relative to said exit port.

* * * * *